US006999380B2

(12) United States Patent
Yamamoto

(10) Patent No.: US 6,999,380 B2
(45) Date of Patent: Feb. 14, 2006

(54) CLOCK APPARATUS ADAPTED TO SUMMER TIME, MONITORING CAMERA APPARATUS HAVING THE SAME, AND CLOCK APPARATUS TIME SETTING METHOD

(75) Inventor: Shigeaki Yamamoto, Itami (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 55 days.

(21) Appl. No.: 10/476,889

(22) PCT Filed: May 16, 2002

(86) PCT No.: PCT/JP02/04761

§ 371 (c)(1),
(2), (4) Date: Nov. 14, 2003

(87) PCT Pub. No.: WO02/093275

PCT Pub. Date: Nov. 21, 2002

(65) Prior Publication Data

US 2004/0151072 A1 Aug. 5, 2004

(30) Foreign Application Priority Data

May 16, 2001 (JP) ..... 2001-145900

(51) Int. Cl.

| | |
|---|---|
| ***G04B 47/00*** | (2006.01) |
| ***G04B 19/22*** | (2006.01) |
| ***G04B 19/24*** | (2006.01) |
| ***G04C 9/00*** | (2006.01) |

(52) U.S. Cl. ..... 368/10; 368/21; 368/28; 368/187

(58) Field of Classification Search ..... 368/21, 368/22, 28, 29, 47, 185, 187, 10
See application file for complete search history.

(56) References Cited

U.S. PATENT DOCUMENTS

| | | | | |
|---|---|---|---|---|
| 4,956,826 | A * | 9/1990 | Coyman et al. | 368/28 |
| 5,490,123 | A * | 2/1996 | Biver | 368/295 |
| 5,901,115 | A * | 5/1999 | Katzmann et al. | 368/21 |
| 6,223,050 | B1 * | 4/2001 | Roberts, Jr. | 455/425 |

FOREIGN PATENT DOCUMENTS

| | | |
|---|---|---|
| JP | 2001-42072 | 2/2001 |
| JP | 2001-83268 | 3/2001 |

* cited by examiner

*Primary Examiner*—Vit W. Miska
(74) *Attorney, Agent, or Firm*—Armstrong, Kratz, Quintos, Hanson & Brooks, LLP

(57) ABSTRACT

A timepiece comprises a standard time clock for counting standard time and means for calculating daylight saving time by adding a predetermined time correction value to the standard time when judging that the standard time is within the period of daylight saving time. When a time input for setting the timepiece is after a daylight saving time starting time as expressed in the standard time and before a daylight saving time starting time as expressed in daylight saving time, the timepiece corrects the input time by adding the time correction value thereto and sets the corrected time as daylight saving time for the standard time clock.

A monitoring camera device comprises the timepiece. Time data output from the timepiece when an image is captured is added as image capturing time data to image data obtained by capturing the image.

4 Claims, 6 Drawing Sheets

FIG. 2

| TIME SETTING | |
|---|---|
| (YEAR) | 2001 |
| (MONTH) | 03 |
| (DAY) | 25 |
| (HOURS) | 17 |
| (MINUTES) | 30 |

FIG. 3

DAYLIGHT SAVING TIME SETTING

| | <START> | <END> | <SETTING> |
|---|---|---|---|
| (MONTH) | 4 | 10 | |
| (CONDITIONS) | FIRST WEEK | LAST | ON |
| (DAY OF THE WEEK) | SUN. | SUN. | OFF |
| (HOURS) | 02 | 02 | |

CASE OF 2001 AD

CLOCK APPARATUS ADAPTED TO SUMMER TIME, MONITORING CAMERA APPARATUS HAVING THE SAME, AND CLOCK APPARATUS TIME SETTING METHOD

TECHNICAL FIELD

The present invention relates to timepieces which are settable accurately and adapted for daylight saving time, surveillance or monitoring camera devices and a time setting method for the timepiece.

BACKGROUND ART

Daylight saving time is a system wherein timepieces are advanced by a predetermined period of time from the standard time during a specified period of from spring to fall. Daylight saving time is presently adopted by at least seventy countries. In the U.S., for example, the period of daylight saving time starts at 2 a.m. on the first Sunday of April and ends at 2 a.m. on the last Sunday of October, and during this period, timepieces are advanced by one hour. Stated more specifically with reference to FIG. 7, the period of daylight saving time in 2001 AD starts at 2 a.m. on the first Sunday of April, i.e., April 1. Accordingly, the time of day following April 1, 1:59 a.m. is not 2 a.m. but 3 a.m. The period of daylight saving time ends at 2 a.m. on the last Sunday of October, i.e., October 28. Accordingly, the time of day following October 28, 1:59 a.m. is not 2 a.m. but returns to 1 a.m.

The timepiece adapted for daylight saving time automatically advances the standard time by a specified time correction value to indicate daylight saving time during the period of this system. Such a timepiece needs to have set therein information serving to provide a basis for judging whether the current time is within the period of daylight saving time. Generally provided as this information are conditions for a transition from the standard time to daylight saving time (hereinafter referred to as "DST transition conditions") which are determined for each year and which comprise the starting time and ending time of the period of daylight saving time. In the case of the U.S. in 2001 AD shown in FIG. 7, determined as the DST transition conditions are "the first Sunday of April, 2 a.m." as the starting time of the period of daylight saving time and "the last Sunday of October, 2 a.m." as the ending time of the period. The starting time is expressed in the standard time, and the ending time in daylight saving time.

In the case of such a timepiece, the user must seta time of day after turning on the power source. Further in the case where the time indicated differs from the correct time, the user must input the correct time to the timepiece to correct the time setting. Accordingly when the timepiece is to be set or corrected, it is likely that a time that can not exist under the system of daylight saving time will be input. Such a situation is very likely to occur in the case where the timepiece is set immediately after the start of the period of daylight saving time with reference to the indication of a timepiece which is not adapted for daylight saving time or which has not been changed over to this system. After the timepiece has been set, the timepiece counts time based on the time setting. Accordingly, if set erroneously, the timepiece will indicate incorrect times.

For example, reference will be made to the case of the U.S. shown in FIG. 7. When a time during the period of from 2 a.m. to 2:59 of April 1 (Sunday) is input to the timepiece, the input time fulfills the DST transition conditions and is therefore interpreted as being under the system of daylight saving time. However, such a time does not exist under the system of daylight saving time, and the timepiece is set in error.

Timepieces are used not only for indicating times but are used also as incorporated in a main apparatus to supply required time data to the main apparatus. For example, surveillance or monitoring camera devices for capturing images at intervals of a predetermined time period and recording the image data obtained are provided with a timepiece for giving time data to the image data. Such camera devices are intended for surveillance or monitoring for continually recording image data at intervals of a predetermined period of time, the time data for affording information as to the image capturing time must be accurate at all times. Setting the timepiece erroneously must be avoided especially in the case of the timepiece incorporated in the monitoring camera device.

The present invention provides a timepiece which is adapted for daylight saving time so that even if a time erroneous under the system of daylight saving time is set for the timepiece, the input time is automatically corrected for correct time setting, a time setting method for the timepiece, and a monitoring camera device comprising the timepiece.

DISCLOSURE OF THE INVENTION

The present invention provides a timepiece comprising a standard time clock for counting standard time and means for calculating daylight saving time by adding a predetermined time correction value to the standard time when judging that the standard time is within the period of daylight saving time, the timepiece being characterized in that when a time input for setting the timepiece is after a daylight saving time starting time as expressed in the standard time and before a daylight saving time starting time as expressed in daylight saving time, the input time is corrected by adding the time correction value thereto to set the corrected time as daylight saving time.

According to the invention, the timepiece is adapted to judge whether the time input for time setting is a time that is attributable to a changeover to daylight saving time and can not exist under the system of daylight saving time. Even when the time that can not exist under this system is input, the timepiece corrects the input time by adding a time correction value thereto, and handles the corrected time as daylight saving time. Thus, the timepiece is set, with the corrected time, that is a daylight saving time, entered as the time to be set. Accordingly correct time is set for the timepiece even if a time that can not exist under the system of daylight saving time is input.

The present invention further provides a timepiece which, when a time input for setting the timepiece is after a daylight saving time starting time as expressed in the standard time and before a daylight saving time starting time as expressed in daylight saving time, the timepiece sets the input time as it is for the standard time clock. Thus, correct time is set for the timepiece even if a time that can not be present under the System of daylight saving time is input.

The present invention further provides a monitoring camera device which comprises the above timepiece and wherein time data output from the timepiece when an image is captured is added as image capturing time data to image data obtained by capturing the image.

The monitoring camera device has the timepiece incorporated therein, whereby accurate time data can be added to the image data recorded successively and continually at intervals of a predetermined period of time even when a time that can not exist under the system of daylight saving time is input.

The present invention provides a time setting method for a timepiece comprising a standard time clock for counting standard time and means for calculating daylight saving time by adding a predetermined time correction value to the standard time when judging that the standard time is within the period of daylight saving time, the time setting method being characterized in that the method comprises the steps of: inputting to the timepiece the time to be set, judging whether the input time is after a daylight saving time starting time as expressed in the standard time and before a daylight saving time starting time as expressed in daylight saving time, correcting the input time by adding the time correction value thereto when the input time is after a daylight saving time starting time as expressed in the standard time and before a daylight saving time starting time as expressed in daylight saving time, and setting the corrected time as daylight saving time.

The invention provides another time setting method for a timepiece which method is characterized by setting an input time as it is for the standard time clock when the input time is after a daylight saving time starting time as expressed in the standard time and before a daylight saving time starting time as expressed in daylight saving time.

According to the method of the invention, the timepiece is adapted to judge whether the time input for time setting can not exist under the system of daylight saving time, and correct time is set for the timepiece even if the time input can not exist under the system of daylight saving time.

BRIEF DESCRIPTION OF THE DRAWINGS

FIG. 2 is a diagram showing a representation on the display screen of a monitor when a time of day is set;

FIG. 3 is a diagram showing a representation on the display screen of the monitor when daylight saving time is set;

BEST MODE OF CARRYING OUT THE INVENTION

Figure 7:
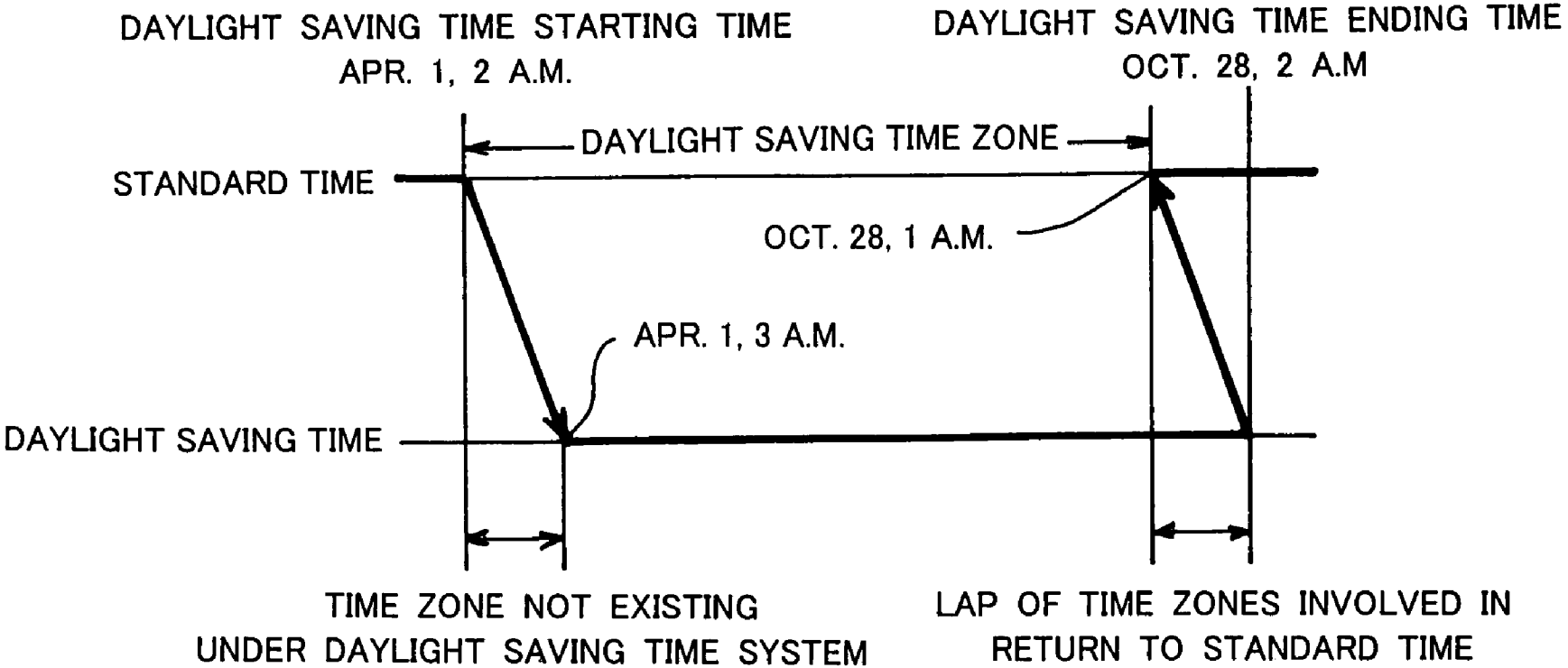
FIG. 7 is a diagram for illustrating a system of daylight saving time.

Embodiments of the present invention will be described below in detail with reference to the drawings. The system of daylight saving time will be described with reference to the case of the U.S. in 2001 shown in FIG. 7.

Figure 1:
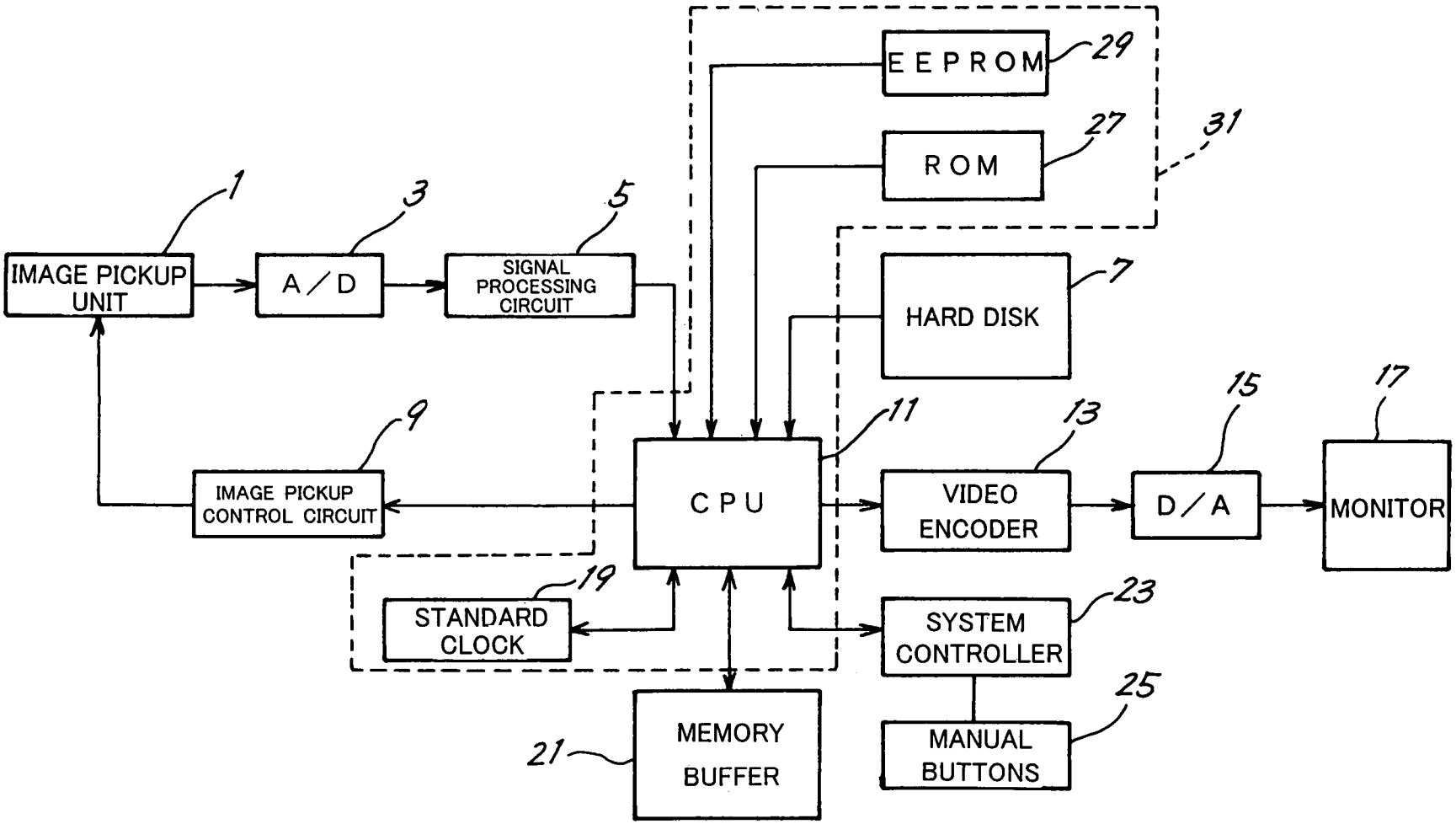
FIG. 1 is a block diagram of a monitoring camera device embodying the invention.

FIG. 1 is a block diagram of an embodiment of the invention, i.e., a monitoring camera device. This camera device comprises a timepiece 31 adapted for daylight saving time. An image pickup unit 1 comprises an optical lens, diagram mechanism and solid image pickup element such as CCD. The image pickup unit 1 is controlled by an image pickup control circuit 9 which is operable in response to a control signal from a CPU 11. An A/D converter 3 converts an analog image signal input from the image pickup unit 1 to a digital image signal. The digital image signal is processed by a signal processing circuit 5 for color separation, gamma correction, white balance adjustment, etc. The resulting digital image data is compressed by the CPU 11 and stored in a memory buffer 21 as compressed data. According to the present embodiment, the image data is compressed by the JPEG method. CPU 11 performs calculations of daylight saving time, processing based on the DST transition conditions, etc. Connected to the CPU 11 are a ROM 27 having stored therein programs prescribing the processing to be executed by the CPU 11, and EEPROM 29 having the DST transition conditions. The CPU 11, ROM 27 and EEPROM 29 constitute the timepiece 31 along with a standard clock 19 for outputting standard time data. The standard clock 19 delivers standard time data to the CPU 11 in a predetermined cycle at all times.

The compressed image data stored in the memory buffer 21 has attached thereto, as subinformation, image capturing time data output from the CPU 11 when images are captured. The compressed image data is stored via the CPU 11 on a hard disk 7 which is a recording medium randomly accessible. The CPU 11 processes the compressed image data on the hard disk 7 for the expansion of the data. A video encoder 13 adds a synchronizing signal and color burst signal to the digital image signal resulting from expansion of the data. The image signal is thereafter converted to an analog image signal by a D/A converter 15. A monitor 17 displays images based on the analog image signal. The monitor 17 serves also as a display for indicating to the user various settings, especially settings of times of day or the DST transition conditions.

A system controller 23 controls the CPU 11 in response to the manipulation of manual buttons 25. When suitably manipulated, manual buttons 25 set the timepiece 31 in a time setting mode. In the time setting mode, particulars about a time setting are presented on the screen of the monitor 17 as shown in FIG. 2. While watching the monitor 17, the user manipulates manual buttons 25 to input year, month, day, hours and minutes. These items are entered by manipulating numeral buttons, decision button, cancel button, etc. included among the manual buttons 25. In place of or in addition to the numeral buttons, the manual buttons 25 include a cross button for moving a cursor on the screen and an up-down button for increasing or decreasing a number on the screen. Items may be entered using these buttons. When a time is set, the timepiece 31 starts to count time at the set time.

When the timepiece 31 is set in a daylight saving time setting mode by manipulating manual buttons 25, particulars about a daylight saving time setting are presented on the screen of the monitor 17 as shown in FIG. 3. While watching the monitor 17, the user enters the starting time and ending time of daylight saving time by manipulating manual buttons 25. In the daylight saving time setting mode, it is possible to determine whether the DST transition conditions set are valid. When the setting of DST transition conditions is made "off," the timepiece 31 outputs standard time even during the period of daylight saving time. In the state shown in FIG. 3, the DST transition conditions are "on," the daylight saving time starting time is set on the first Sunday of April at 2 a.m. as expressed in the standard time, and the daylight saving time ending time is set on the last Sunday of October at 2 a.m. as expressed in daylight saving time.

As previously described, data as to the year is set in the time setting mode. In the case shown in FIG. 2, "2001" is set as year data. In the daylight saving time setting mode, the dates of the daylight saving time starting time and ending time are not shown in numerical values. With reference to the year data, and data as to the calendar for tens of years stored in the ROM 27, the CPU 11 calculates that the first Sunday of April is April 1, and that the last Sunday of October is October 28. The calculated items of data as to the daylight saving time starting time and ending time are stored in the EEPROM 29.

Next, a description will be given of the operation of the timepiece 31 comprising the standard clock 19, CPU 11, etc., with attention directed mainly to the processing to be performed by the CPU 11.

Figure 4:
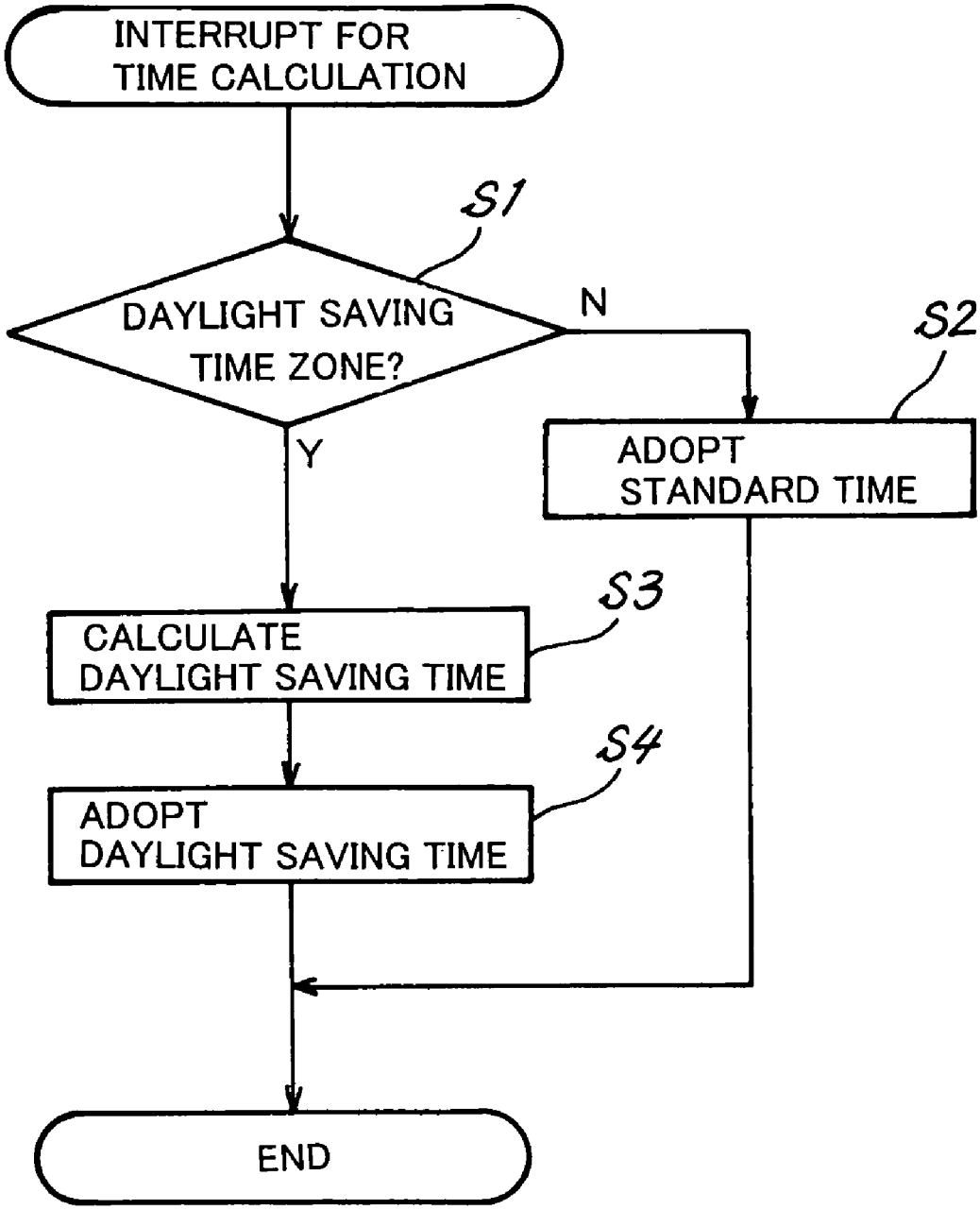
FIG. 4 is a flow chart showing an operation of a timepiece embodying the invention.

First, the time calculating operation of the timepiece 31 will be described with reference to FIG. 4. The CPU 11 calculates time as interrupt processing at intervals of a predetermined period of time, every time an image is captured, or every time image data is stored on the hard disk 7. In the beginning, standard time data output from the standard clock 19 is fed to the CPU 11, which in turn inquires whether the standard time indicated by the data is included in the daylight saving time zone (S1). The term "daylight saving time zone" refers to the daylight saving time starting time as expressed in the standard time and the subsequent time zone before the daylight saving time ending time as expressed in the standard time (not inclusive of the ending time). In the illustrated case of FIG. 7, the daylight saving time starting time according to the standard time is April 1, 2 a.m., and the daylight saving time ending time according to the standard time is October 28, 1 a.m. The CPU 11 inquires whether the standard time indicated by the data is included in the time zone of from April 1, 2 a.m. to October 28, 0:59:59 a.m. When the answer is negative, the timepiece 31 adopts the standard time data output by the standard clock 19 as it is as image capturing time data (S2). The standard time data is used as subinformation for the image data or display data on the monitor 17.

When the answer to the inquiry of step S1 is affirmative, the CPU 11 adds a time correction value for use during the period of daylight saving time to the standard time to calculate daylight saving time, and outputs daylight saving time data indicating the daylight saving time (S3). The time correction value for use during the period of daylight saving time refers to the time difference value between the standard time and daylight saving time. In the illustrated case of FIG. 7, the time correction value is 1 hour. The daylight saving time data output from the CPU 11 is used as subinformation for the image data or display data on the monitor 17.

Figure 5:
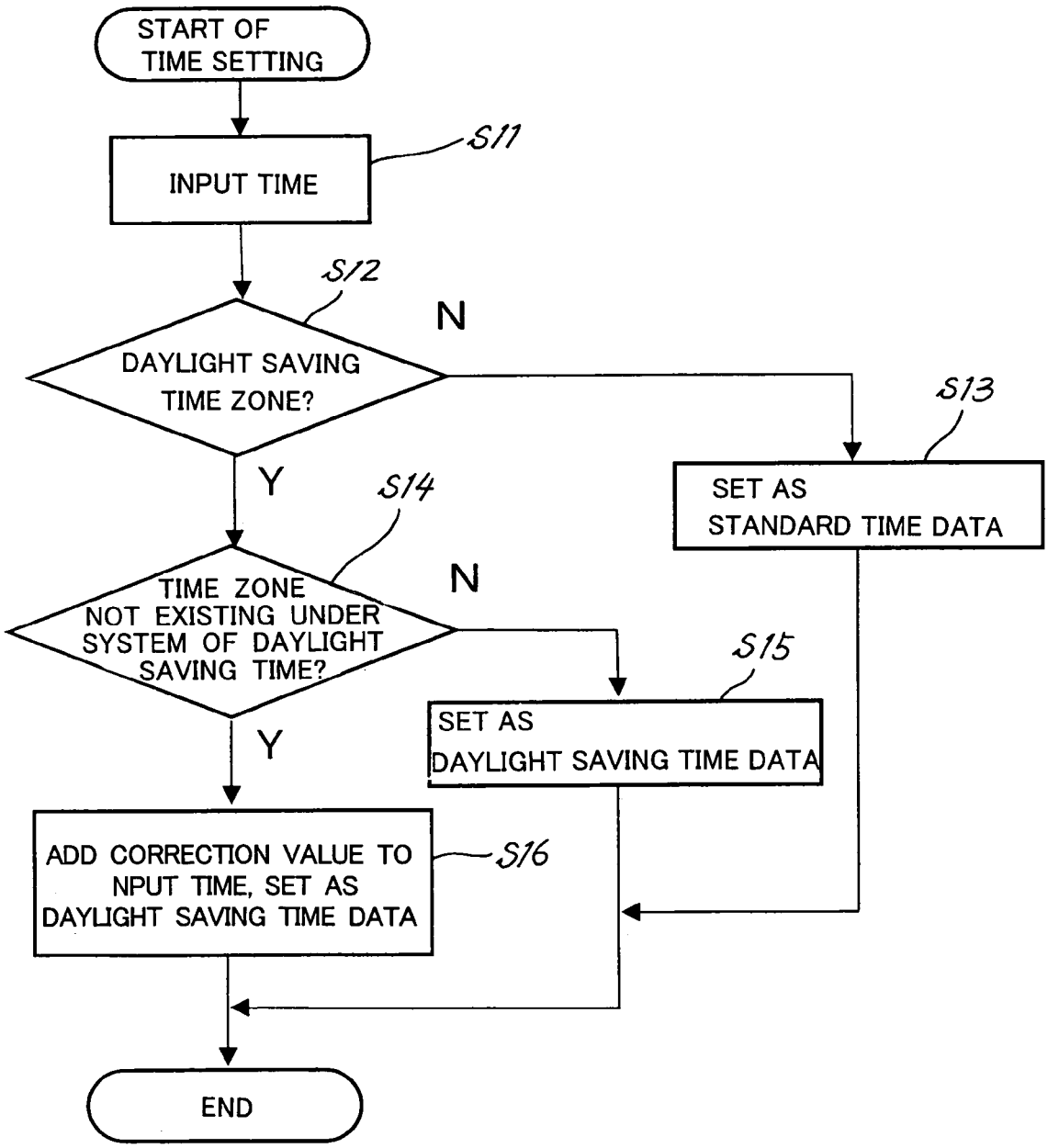
FIG. 5 is a flow chart showing another operation of the timepiece embodying the invention.

Next, the time setting operation of the timepiece 31 will be described with reference to FIG. 5. First, the user enters in the timing setting mode the time to be set and comprising year, month, day, hours and minutes as shown in FIG. 2 by manipulating manual buttons 25 (S11). The CPU 11 then inquires whether the time is included in the daylight saving time zone (S12). As previously stated, the term "daylight saving time zone" refers to the daylight saving time starting time as expressed in the standard time and the subsequent time zone before the daylight saving time ending time. Stated more specifically with reference to the illustrated case of FIG. 7, the daylight saving time zone is a time zone of from April 1, 2 a.m. to October 28, 0:59:59 a.m. as expressed in the standard time.

In the case where the input time is outside daylight saving time zone, the CPU 11 judges the input time to be standard time, and sets the time data indicating the input time as it is for the standard clock 19 (S13). The standard clock 19 having the time data stored therein starts to count standard time at the time indicated by the time data.

In the case where the input time is found to be within the daylight saving time zone (S12), the CPU 11 then inquires whether the input time is included within a time zone which does not exist under the system of daylight saving time (S14) The time zone not existing under the system of daylight saving time is after the daylight saving time starting time as expressed in the standard time and the subsequent time zone before (and not including) the daylight saving time starting time as expressed in daylight saving time (i.e., time corresponding to the starting time as expressed in the standard time plus the time correction value). In the illustrated case of FIG. 7, the time zone not existing under the system of daylight saving time is a time zone of from April 1 (Sunday), 2 a.m. to 2:59: a.m. When the input time is outside the time zone not existing under the system of daylight saving time, the CPU 11 judges the input time to be daylight saving time, converts the input time to standard time, and sets the time indicating the converted standard time for the standard clock 19 (S15). In the illustrated case of FIG. 7, time data indicating a time corresponding the input time minus 1 hour is set for the standard clock 19. The standard clock 19 having the time data stored therein starts to count standard time at the time indicated by the time data.

When the input time is within the daylight saving time zone and is found to be in the time zone not existing under the system of daylight saving time (S14), the input time is corrected by adding thereto the time correction value for use during the daylight saving time zone. The standard clock 19 is set based on the corrected time. With the corrected time interpreted as being daylight saving time, the CPU converts the corrected time to standard time as in step S15, and the standard time as converted from the corrected time is set for the standard clock 19 (S16). In the illustrated case of FIG. 7, the input time (e.g., April 1, 2:10 a.m.) plus 1 hour is the corrected time (April 1, 3:10 a.m.), and the time (April 1, 2:10 a.m.) obtained by subtracting 1 hour from the corrected time is set for the standard clock 19. Even if the input time is within a time zone not existing under the daylight saving time, it is unlikely that the value obtained by subtracting the time correction value for use during the period of daylight saving time from the input time will be set for the standard clock 19. Thus, correct time is set for the timepiece 31 by the above procedure.

Figure 6:
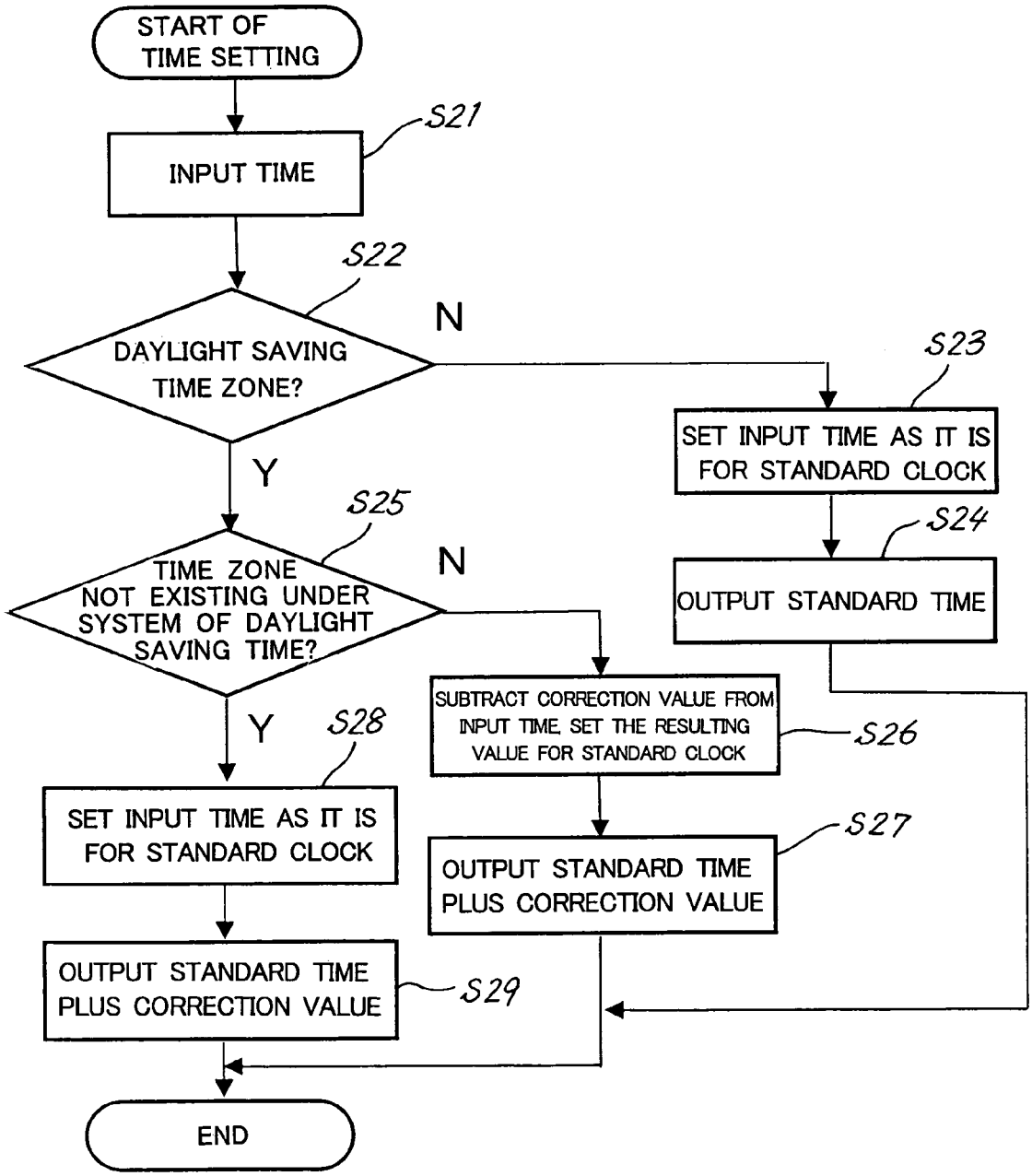
FIG. 6 is a flow chart showing the operation of a second embodiment of timepiece of the invention.

FIG. 6 shows a second embodiment of time setting operation of the timepiece 31 of the invention. First, the user manipulates manual buttons 25 to input the time to be set (S21). CPU 11 then inquires whether the input time is included within the daylight saving time zone (S22). If the input time is outside the daylight saving time zone, CPU 11 judges the input time to be standard time, and time data indicating the input time is set as it is for the standard clock 19 (S23). The standard clock 19 having the time data stored therein starts to count standard time at the time indicated by the time data, and the timepiece 31 outputs standard time data obtained from the standard clock 19 (S24).

When the input time is found to be within the daylight saving time zone (S22), the CPU 11 inquires whether the input time is included in a time zone not existing under the system of daylight saving time (S25). In the case where the input time is outside the time zone not existing under the system of daylight saving time, the CPU 11 judges the input time to be daylight saving time, converts the input time to standard time, and set a time indicating the converted standard time for the standard clock 19 (S26). Thus, time data indicating a time obtained by subtracting the time correction value from the input time is set for the standard clock 19. The standard clock 19 having the time data stored therein starts to count standard time at the time indicated by the time data, and the timepiece 31 outputs (in step S27) time data indicating a time obtained by adding the time correction value to the standard time according to the procedure shown in FIG. 4 (S3, S4).

In the case where the input time is within the time zone not existing under the system of daylight saving time (S25), the CPU 11 sets time data indicating the input time, as it is for the standard clock 19 (S28). The standard clock 19 having the input time data stored therein starts to count standard time at the time indicated by the time data, and the timepiece 31 outputs (in step S29) time data indicating a time obtained by adding time correction value to the standard time according to the procedure of FIG. 4 (S3, S4).

While embodiments of the present invention have been described above, the hard disk used as a recording medium for image data and the JPEG method used for compressing the image data for recording are intended to illustrate one embodiment of the invention, and the present invention are not limited to such means or method.

What is claimed is:

1. A timepiece comprising a standard time clock for counting standard time and a processing unit for calculating daylight saving time by adding a predetermined time correction value to the standard time when judging that the standard time is within the period of daylight saving time, the timepiece being characterized in that the processing unit judges whether a time input for setting the timepiece is after a daylight saving time starting time as expressed in the standard time and before a daylight saving time starting time as expressed in daylight saving time, and when the input time is within this time zone, the processing unit corrects the input time by adding the time correction value thereto to set the corrected time as daylight saving time.

2. A timepiece comprising a standard time clock for counting standard time and a processing unit for calculating daylight saving time by adding a predetermined time correction value to the standard time when judging that the standard time is within the period of daylight saving time, the timepiece being characterized in that the processing unit judges whether a time input for setting the timepiece is after a daylight saving time starting time as expressed in the standard time and before a daylight saving time starting time as expressed in daylight saving, and when the input time is within this time zone, the processing unit sets the input time as it is for the standard time clock.

3. A time setting method for a timepiece comprising a standard time clock for counting standard time and a processing unit for calculating daylight saving time by adding a predetermined time correction value to the standard time when judging that the standard time is within the period of daylight saving time, the time setting method being characterized in that the method comprises the steps of:

inputting to the timepiece the time to be set, judging with use of the processing unit whether the input time is after a daylight saving time starting time as expressed in the standard time and before a daylight saving time starting time as expressed in daylight saving time, correcting the input time by adding the time correction value thereto with use of the processing unit when the input time is after a daylight saving time starting time as expressed in the standard time and before a daylight saving time starting time as expressed in daylight saving time, and setting the corrected time as daylight saving time with use of the processing unit.

4. A time setting method for a timepiece comprising a standard time clock for counting standard time and a processing unit for calculating daylight saving time by adding a predetermined time correction value to the standard time when judging that the standard time is within the period of daylight saving time, the time setting method being characterized in that the method comprises the steps of:

inputting to the timepiece the time to be set, judging with the use of the processing unit whether the input time is after a daylight saving time starting time as expressed in the standard time and before a daylight saving time starting time as expressed in daylight saving time, and setting the input time as it is for the standard time clock with use of the processing unit when the input time is after a daylight saving time starting time as expressed in the standard time and before a daylight saving time starting time as expressed in daylight saving time.

* * * * *